US012312147B1

(12) United States Patent
Miller et al.

(10) Patent No.: US 12,312,147 B1
(45) Date of Patent: May 27, 2025

(54) BOTTLING DEVICE AND METHOD

(71) Applicants: Adam Miller, Brookfield, CT (US); Roger Miller, Brookfield, CT (US)

(72) Inventors: Adam Miller, Brookfield, CT (US); Roger Miller, Brookfield, CT (US)

( * ) Notice: Subject to any disclaimer, the term of this patent is extended or adjusted under 35 U.S.C. 154(b) by 0 days.

(21) Appl. No.: 17/726,940

(22) Filed: Apr. 22, 2022

Related U.S. Application Data

(63) Continuation of application No. 16/162,450, filed on Oct. 17, 2018, now Pat. No. 11,377,285.

(60) Provisional application No. 62/573,257, filed on Oct. 17, 2017.

(51) Int. Cl.

| | |
|---|---|
| ***B65D 77/28*** | (2006.01) |
| ***A47G 21/18*** | (2006.01) |
| ***B65D 1/02*** | (2006.01) |
| ***B65D 23/08*** | (2006.01) |
| ***B65D 41/04*** | (2006.01) |
| ***B65D 47/08*** | (2006.01) |

(52) U.S. Cl.
CPC ..... *B65D 77/283* (2013.01); *A47G 21/183* (2013.01); *B65D 1/0246* (2013.01); *B65D 23/0842* (2013.01); *B65D 41/04* (2013.01); *B65D 47/0838* (2013.01); *B65D 2501/0036* (2013.01)

(58) Field of Classification Search
CPC .. B65D 77/283; B65D 23/0842; B65D 41/04; B65D 47/0838; B65D 1/0246; B65D 2501/0036; A47G 21/183
USPC ..... 215/44
See application file for complete search history.

(56) References Cited

U.S. PATENT DOCUMENTS 2,849,321 A * 8/1958 Lhermitte ..... B65D 77/40 426/85
3,291,331 A * 12/1966 Grisham ..... B65D 77/283 215/388
3,568,870 A * 3/1971 Elston ..... B65D 77/283 215/388
3,615,595 A * 10/1971 Guttag ..... A23L 27/74 426/85
4,265,363 A * 5/1981 Conn ..... B65D 77/283 215/229
4,744,477 A * 5/1988 Wofford ..... B65D 77/283 215/229
4,877,148 A * 10/1989 Larson ..... B65D 77/283 220/706
5,054,264 A * 10/1991 Miller ..... B65D 75/5827 53/412
5,094,861 A * 3/1992 D'Auguste ..... A23P 10/10 426/112
5,160,058 A * 11/1992 Ahn ..... B65D 77/283 215/388
5,431,297 A * 7/1995 Rosello ..... B65D 77/283 215/389
5,482,202 A * 1/1996 Wen ..... B65D 77/283 220/705

(Continued)

*Primary Examiner* — Ernesto A Grano
(74) *Attorney, Agent, or Firm* — MacCord Mason PLLC

(57) ABSTRACT

Beverage packaging and container arrangements are shown and described. In one embodiment, the device comprises a container body, hollow rod, and removable cap to provide an assembled consumable beverage arrangement. The disclosure also includes a variety of fittings and removable caps to mate with beverage containers that are useful in both storage and operating positions.

9 Claims, 7 Drawing Sheets

(56) References Cited

U.S. PATENT DOCUMENTS 5,722,219 A * 3/1998 Dobransky ..... A47G 21/182 206/446
5,727,734 A * 3/1998 Su ..... A47G 21/189 215/388
6,076,729 A * 6/2000 Cornell ..... B65D 5/067 220/706
6,116,446 A * 9/2000 Haughton ..... B65D 77/28 215/355
6,142,326 A * 11/2000 Cornell ..... B65D 71/066 215/388
6,230,913 B1 * 5/2001 Cornell ..... B65D 71/066 215/387
6,283,294 B1 * 9/2001 Thorball ..... A23L 2/52 206/438
6,427,928 B1 * 8/2002 Hirota ..... B65D 77/283 215/229
6,431,382 B1 * 8/2002 Li ..... B65D 77/283 215/388
6,929,135 B1 * 8/2005 Hajianpour ..... B65D 47/32 215/229
D550,496 S * 9/2007 Stribling ..... D7/300.2
7,753,284 B1 * 7/2010 Raitses ..... A47G 21/18 239/33
7,950,542 B2 * 5/2011 Steadman ..... B65D 17/506 220/294
10,287,076 B1 * 5/2019 Ryan ..... B65D 65/02
2002/0030059 A1 * 3/2002 Hirota ..... B65D 77/283 220/704
2002/0079320 A1 * 6/2002 McCarthy ..... B65D 17/4012 220/705
2002/0121495 A1 * 9/2002 Kozlov ..... B65D 77/283 215/229
2003/0203075 A1 * 10/2003 Taylor ..... A47G 21/18 426/85
2004/0109932 A1 * 6/2004 Chen ..... A23G 3/36 426/660
2006/0006134 A1 * 1/2006 Luo ..... B65D 77/283 215/388
2006/0037961 A1 * 2/2006 Suissa ..... B65D 77/283 220/705
2006/0163194 A1 * 7/2006 Vladimirovich ..... B65D 77/283 215/388
2007/0051741 A1 * 3/2007 Gaonkar ..... A23L 5/40 426/85
2007/0125744 A1 * 6/2007 Samman ..... B65D 25/205 215/388
2007/0158454 A1 * 7/2007 Ching-Chong ..... B65D 77/283 239/33
2008/0034628 A1 * 2/2008 Schnuckle ..... B65D 23/085 40/310
2009/0162492 A1 * 6/2009 Conway, Jr. ..... A47G 21/18 426/85
2010/0270321 A1 * 10/2010 Kiss ..... B65D 77/283 220/706
2011/0108560 A1 * 5/2011 Ravelo ..... B65D 77/283 220/705
2012/0261292 A1 * 10/2012 Lieb ..... B65D 75/38 206/457
2012/0301579 A1 * 11/2012 Lee ..... A47G 21/183 426/85
2013/0240543 A1 * 9/2013 Jordan ..... A47G 19/2222 220/710
2013/0287902 A1 * 10/2013 Ayeni ..... A47G 21/18 426/85
2014/0004228 A1 * 1/2014 Lipson ..... A47G 21/183 426/85
2014/0084077 A1 * 3/2014 Knight ..... A47G 21/183 239/33
2014/0110411 A1 * 4/2014 Saslekov ..... B65D 75/525 220/495.03
2014/0263377 A1 * 9/2014 Olmedo ..... A47G 19/2222 220/708
2015/0209567 A1 * 7/2015 Coulson ..... A01N 25/34 138/137
2017/0055739 A1 * 3/2017 Chen ..... B65D 51/24
2017/0238742 A1 * 8/2017 Peterson ..... A23L 27/74
2018/0028007 A1 * 2/2018 Lazarov ..... A47G 21/183
2018/0098652 A1 * 4/2018 Ecseri ..... A47G 21/183
2018/0338629 A1 * 11/2018 Da Silva ..... B65D 17/4011
2019/0000719 A1 * 1/2019 Nolimal ..... A61J 7/0038

* cited by examiner

BOTTLING DEVICE AND METHOD

This application is a Continuation of U.S. application Ser. No. 16/162,450, filed Oct. 17, 2018, which claims the benefit of U.S. Provisional Application No. 62/573,257, filed Oct. 17, 2017, all of which are incorporated herein by reference in their entireties.

FIELD OF THE TECHNOLOGY

The present disclosure relates generally to beverage bottles, and more particularly to improved bottling systems and arrangements.

BACKGROUND

It is desirable to provide convenient, innovative, and efficient bottling of consumer beverages for widespread on-site use and enjoyment. Classical methods for accessing beverages include tipping, sipping, sucking, etc. bottles, which presents unwanted hardships and often unpleasant side-effects in a variety of environments. Further, traditional assemblies often fail to benefit from exploiting marketing and display opportunities on beverage arrangements.

Therefore, Applicants desire systems and methods for appealing beverage containers and assemblies without the drawbacks presented by the traditional systems and methods.

SUMMARY

In accordance with the present disclosure, beverage bottling arrangements are provided for various uses. This disclosure provides improved structures and assemblies that are convenient, efficient, and safe, particularly when used to quench personal thirst. This disclosure additional provides branding and advertisement avenues.

In one embodiment of the present disclosure, an apparatus for packaging a beverage item includes a container body having a closed bottom, a top, a sidewall, an opening upper face, wherein said bottom, top, and sidewall define a spatially-confined interior; a hollow rod body removably aligned within said spatially-confined interior and below said upper face in a storage position; and a removable cap fitting adapted to form a seal with said top and having at least one compression bearing platform adapted to exert tension on said hollow rod body in said storage position, and wherein said device being a disposable item removably biased in said single-use container body, and wherein said device being adapted to transfer said hollow rod from said spatially-confined interior area in an unbiased position to an off-axis alignment biased position above said upper face in a single-use operating position.

In some examples, said hollow rod has a vertical height dimension greater than a vertical height dimension of said container body, and whereby said hollow rod aligned at an angle alpha with respect to a bottom surface of said container body in said storage position. The hollow rod may have a disposable, single-use rod. The hollow rod may include an outer surface comprising an outer body wrap. The hollow rod may include a flavored straw, and in certain examples flavored pellets affixed to said flavored straw. The outer body wrap may include at least one graphic. The container body may include at least one corresponding graphic. The container body may include a male connector and said cap fitting includes a female connector adapted to mate with said male connector in a removably affixed, liquid impermeable position.

In another embodiment, an assembly for exposing and positioning a hollow rod from a single use application includes a container frame having a bottom surface; a cap adapted to mate with said container frame; a substantially hollow rod having an upper end, a lower end, and a periphery, said hollow rod aligned at an angle alpha with respect to said container's bottom surface in a storage position; and a liquid enclosing said rod's lower end and periphery and exposing said upper end through said container frame in an operating position.

In certain examples, the container frame includes at least one graphic chosen from a label, an advertisement, a scenic view, and combination thereof. The substantially hollow rod may include at least one corresponding graphic. The substantially hollow rod may include a flavored straw. The substantially hollow rod may include a flavoring layer. The substantially hollow rod may include a height dimension greater than a height dimension of said container frame. The substantially hollow rod being aligned at an angle alpha with respect to a bottom surface of said container frame in said storage position.

In yet another embodiment, a disposable beverage packaging container includes a substantially conical recyclable container body adapted to retain a consumable beverage, said container body including: a rounded sidewall, a substantially conical anterior extending from said sidewall, an upper segment adjacent said conical anterior and comprising a plurality of threads, and an orifice upper face exposed on said upper segment; a rigid hollow, single-use rod comprising a proximate end received within said container body and a distal end, wherein said hollow rod having a height dimension extending above said opening upper face; and a removable cap having opposing threads, wherein said removable cap enclosing said distal end of said hollow rod and mating with said container's threads in a closed position.

In some examples, the rounded sidewall includes a smooth surface comprising an outer body wrap. The rod may be a recyclable rod temporarily secured between said container body and said cap, and wherein said hollow rod body having a second height dimension of about five to about ten percent larger than said first height dimension. The cap conceals said rod and aligns over said orifice face of said container body to define a liquid impermeable shape in an assembled position.

In a further embodiment of the present disclosure, a beverage packaging container includes a substantially conical container body adapted to retain a consumable beverage, the container body, a rigid hollow rod comprising a proximate end received within the container body and a distal end, wherein the hollow rod having a height dimension extending above the opening upper face; and a removable cap having opposing threads, wherein the removable cap enclosing the distal end of the hollow rod and mating with the container's threads in a closed position. Typically the container body includes a rounded sidewall, a substantially conical anterior extending from the sidewall, an upper segment adjacent the conical anterior and comprising a plurality of threads, and an orifice upper face exposed on the upper segment.

In some examples, the rounded sidewall includes a smooth surface comprising an outer body wrap. The outer body wrap may include wrap chosen from a label, an advertisement, a scenic view, and combination thereof. The removable cap may include a height dimension greater than a height of the upper segment. The removable cap may include a height dimension greater than a height of the container's plurality of threads. The removable cap may include an upper tapered edge. The removable cap may include a lower squared edge aligned with the threads. The apparatus may also include a quick connect assembly securing the removable cap about the container body.

Another embodiment of the present disclosure includes an apparatus for packaging a beverage item having a container body having a closed bottom, a top, a sidewall, an orifice upper face, wherein the bottom, top, and sidewall define a spatially-confined interior; a hollow rod body having a proximate end contained within the spatially-confined interior and a distal end extending above the upper face in a storage position and in an operating position; and a removable cap fitting adapted to form a seal with the top, and wherein the cap fitting having a height dimension to enclose the rod body's distal end and the container body's top.

In particular examples, the hollow rod body having a height dimension greater than a height dimension of the container body. The hollow rod body may be perpendicular with respect to the closed bottom and the removable cap in the storage position. Further, the hollow rod body may be aligned perpendicular with respect to the closed bottom and the cap in the operating position.

In some examples, the hollow rod body includes an outer surface comprising an outer body wrap. Further, the outer body wrap may include at least one graphic. The hollow rod body may include a flavored straw. In addition, flavored pellets may be affixed to the flavored straw. The container body may include at least one graphic.

A further embodiment of the present disclosure includes a consumable beverage assembly including a container body having an upper segment comprising an exposed upper face; a hollow rod comprising a proximate end received within the container body and a distal end extending beyond the opening upper face; a consumable liquid within the container body; and a removable cap mating with the upper segment in a closed position.

In some examples, the container body comprises a substantially rounded sidewall. The container body may include a substantially conical anterior extending from the sidewall. The upper segment may include a plurality of threads. The hollow rod may include a height dimension extending above the orifice upper face. The hollow rod may include a height dimension greater than a height dimension of the container body. The hollow rod may be aligned perpendicular with respect to a bottom portion of the container and to the removable cap in the storage position. Further, the hollow rod may be aligned perpendicular with respect to a bottom portion of the container and to the removable cap in the operating position.

In particular examples, the rod includes an outer surface comprising an outer body wrap. The outer body wrap may include at least one graphic. The hollow rod may include a flavored straw. For instance, the flavored pellets affixed to the flavored straw. Further, the container may include at least one graphic.

Yet a further embodiment of the present disclosure includes an apparatus for packaging a beverage item including a container body having a closed bottom, a top comprising an indented ledge and a narrow orifice, and a sidewall, wherein the bottom, top, and sidewall define a spatially-confined interior; a hollow rod body having a proximate end contained within the spatially-confined interior and a distal end extending above the narrow orifice in a storage position and in an operating position; and a removable cap fitting adapted to form a seal with the top, and wherein the cap fitting having a height dimension to enclose the rod body's distal end and the container body's top.

In some examples, the hollow rod body having a height dimension greater than a height dimension of the container body. The hollow rod body may be aligned perpendicular with respect to the closed bottom and the removable cap in the storage position. Further, the hollow rod body may be aligned perpendicular with respect to the closed bottom and the cap in the operating position.

In particular examples, the hollow rod body includes an outer surface comprising an outer body wrap. The outer body wrap may include at least one graphic. The hollow rod body may include a flavored straw, for instance flavored pellets affixed to the flavored straw. The container body may include at least one graphic.

Another embodiment of the present disclosure includes a consumable beverage assembly including a container body having an upper planar ledge and a narrow orifice; a hollow rod comprising a proximate end received within the container body and a distal end extending beyond the narrow orifice; a consumable liquid within the container body; and a removable cap aligned about the planar ledge in a closed position.

In some examples, the removable cap includes a dimension corresponding to the planar ledge. The removable cap may include a radial dimension being more substantially narrow than a radial dimension of the container body. The container body may include a substantially rounded sidewall. The container body may include substantially conical anterior extending from the sidewall. The container may include a plurality of threads. The hollow rod may have a height dimension extending above the orifice upper face. The hollow rod may have a height dimension greater than a height dimension of the container body. The hollow rod may be aligned perpendicular with respect to a bottom portion of the container and to the removable cap in the storage position. Further, the hollow rod aligned perpendicular with respect to a bottom portion of the container and to the removable cap in the operating position.

In particular examples, the hollow rod includes an outer surface comprising an outer body wrap. The outer body wrap may include at least one graphic. The hollow rod may include a flavored straw. The container may include at least one graphic.

An embodiment of the present disclosure includes a beverage packaging container including a container body adapted to retain a consumable beverage, the container body having a rounded sidewall and an upper planar ledge having an orifice; a rigid hollow rod comprising a proximate end received within the container body and a distal end, wherein the hollow rod having a height dimension extending above the orifice; and a removable cap enclosing the distal end of the hollow rod and mating with the container in a closed position.

In some examples, the orifice has a diameter of about half an inch to about an inch, for example five sixteenths of an inch. The rounded sidewall may include a smooth surface comprising an outer body wrap. The outer body wrap may include wrap chosen from a label, an advertisement, a scenic view, and combination thereof. The container body may include a plurality of threads. The removable cap may include a height dimension greater than a height of the plurality of threads. The assembly may also include a quick connect assembly securing the removable cap about the container body.

An embodiment of the present disclosure includes a fitting for a beverage container, the fitting including an upper segment having sidewall; a cap releasably enclosing the upper segment; and a rigid hollow rod comprising a proximate end adapted to be received within the container and a distal end affixed within the sidewall.

Yet a further embodiment of the present disclosure includes an apparatus for packaging a beverage item comprising: a container body having a closed bottom, a top, a sidewall, an opening upper face, wherein the bottom, top, and sidewall define a spatially-confined interior; a hollow rod body removably aligned within the spatially-confined interior and below the upper face in a storage position; and a removable cap fitting adapted to form a seal with the top and having at least one compression bearing platform adapted to exert tension on the hollow rod body in the storage position, and wherein the device adapted to transfer the hollow rod from the spatially-confined interior area to an off-axis alignment position above the upper face in an operating position.

In some examples, the hollow rod having a height dimension greater than a height dimension of the container body. The hollow rod may be aligned at an angle alpha with respect to a bottom surface of the container body in the storage position. The hollow rod may include an outer surface comprising an outer body wrap. The hollow rod may include a flavored straw, including flavored pellets affixed to the flavored straw. The outer body wrap may include at least one graphic. The container body may include at least one corresponding graphic. The container body may include a male connector and the cap fitting includes a female connector adapted to mate with the male connector in a removably affixed, liquid impermeable position.

An embodiment of the present disclosure includes an assembly for exposing and positioning a hollow rod, the assembly including a container frame having a bottom surface; a cap adapted to mate with the container frame; a substantially hollow rod having an upper end, a lower end, and a periphery, the hollow rod aligned at an angle alpha with respect to the container's bottom surface in a storage position; and a liquid enclosing the rod's lower end and periphery and exposing the upper end through the container frame in an operating position.

In some examples, the container frame includes at least one graphic chosen from a label, an advertisement, a scenic view, the like, and combination thereof. The substantially hollow rod may include at least one corresponding graphic. The substantially hollow rod may include a flavored straw. The substantially hollow rod may include a flavoring layer. The substantially hollow rod may include a height dimension greater than a height dimension of the container frame. The substantially hollow rod may be aligned at an angle alpha with respect to a bottom surface of the container frame in the storage position.

A further embodiment of the present disclosure includes beverage device including a container body having a closed bottom, an orifice face, and a first height dimension; a cap adapted to mate with the container frame; and a rod temporarily secured between the container body and the cap, and wherein the hollow rod body having a second height dimension of about five to about ten percent larger than the first height dimension. In some examples, the cap conceals the rod and aligns over the orifice face of the container body to define a liquid impermeable shape in an assembled position.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
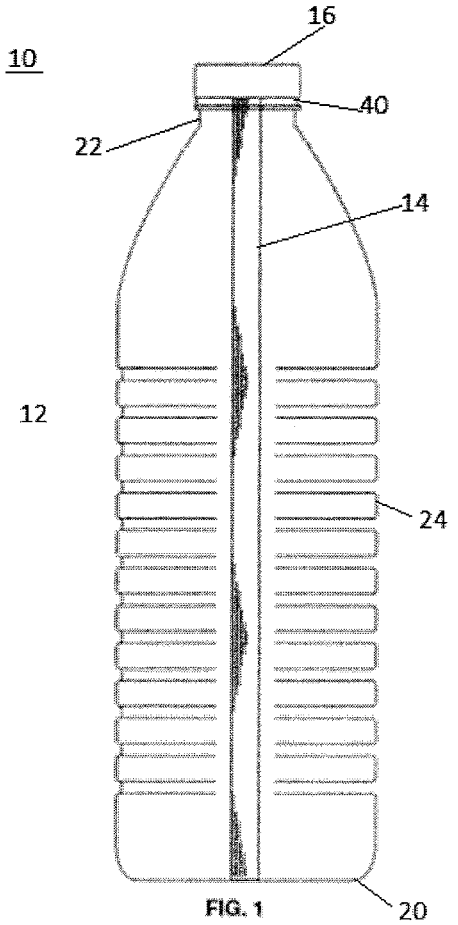
FIG. 1 is a front perspective view of a beverage packaging container according to one embodiment of the disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIGS. 1, 3, 5, and 7 in particular, it will be understood that the illustrations are for the purpose of describing embodiments of the disclosure and are not intended to limit the disclosure or any inventions thereto. As best seen in the figures, the beverage containers 10, 100, 200, and 300 are respectively shown embodied according to the present disclosure.

As shown in FIG. 1, beverage container apparatus 10 for packaging a beverage item includes a container body 12, hollow rod body 14, and removable cap 16. The container body 12 typically has a closed bottom 20, top 22, and sidewall 24. Generally, the bottom 20, top 22, and sidewall 24 define a spatially-confined interior. As introduced in FIG. 2, the top 22 generally includes an opening upper orifice face 26. Those of ordinary skill having the benefit of this disclosure will recognize additional orientations and container arrangements, including a variety of orifice designs and dimensions as shown and described herein.

Figure 2:
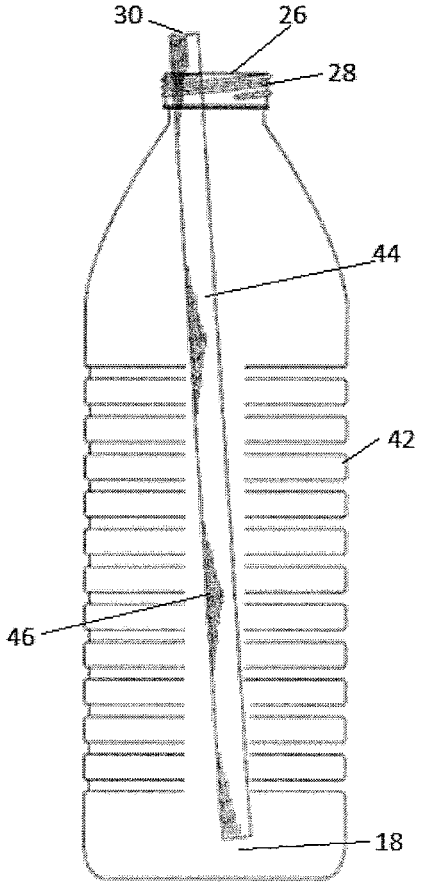
FIG. 2 is a front perspective view of the beverage packaging container embodiment introduced in FIG. 1, with portions omitted to show internal elements.
Figure 2A:
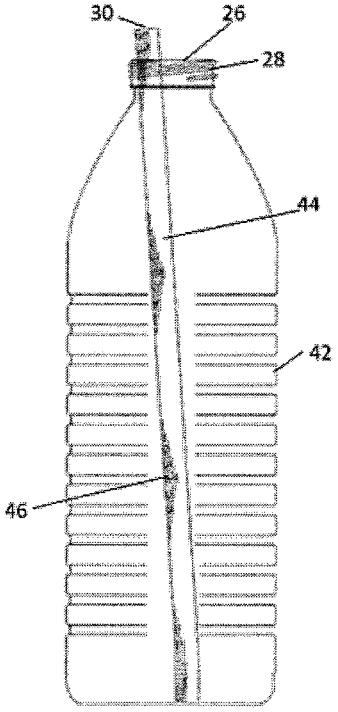
FIG. 2A is a front perspective view of another beverage packaging container embodiment introduced in FIG. 1, with portions omitted to show internal elements.

FIG. 1 illustrates the hollow rod body 14 generally removably aligned within a spatially-confined interior defined by the container and positioned below the opening upper orifice face 26 in a storage position. The storage position may include any variety of sealed, closed arrangements prior to, and in particular examples, re-sealed or re-closed arrangements. As shown in FIG. 1, the hollow rod body 14 may be aligned perpendicular between the removable cap 16 and closed bottom 20. Other examples included a variety of angled or bent hollow rod body 14 shapes in the storage position Typically in this embodiment, the hollow rod body 14 exerts compression against the compression bearing platform 40 of removable cap 16, for instance to maintain alignment and transfer the spring, buoyant, extended hollow rod body 14 to break the plane of the upper orifice face 26 as introduced in FIG. 2. As shown in FIG. 2, particular embodiments of the hollow rod body 14 extend from the spatially-confined interior area to an off-axis alignment position 18 above the upper orifice face 26 in an operating position.

In addition embodiments, the hollow rod body 14 has a height dimension that is generally greater than a height dimension of the spatially-confined interior area of the container body. For instance, the hollow rod body 14 is aligned at an angle alpha about the closed bottom 20 and exerts a compression against the compression bearing platform 40 of removable cap 16.

In any of the embodiments and examples herein, the hollow rod body 14 includes an outer surface comprising an outer body wrap or similar design. Those of ordinary skill in the art will recognize any variety of coloring, graphic, advertisement, a scenic view, marketing scheme, etc. of an outer body wrap. Further, the hollow rod may include a flavoring element, including a flavoring layer 46, pellet, coating, skin, and the like to create any variety of consumable beverage for the end user. In any of the examples and embodiments herein, the rod may include a cylinder shape, rectangle shape, or any other shape, including designer-style rods with curves, loops, and the like. Further, any of the rods and/or containers herein may comprise recyclable materials and the like. Similarly, in any of the embodiments and examples herein, the container body may include any shape, including rounded, rectangular, can-shaped, and the like, and may include an outer graphic or design surface, for instance an outer body wrap 46 or similar design.

Figure 3:
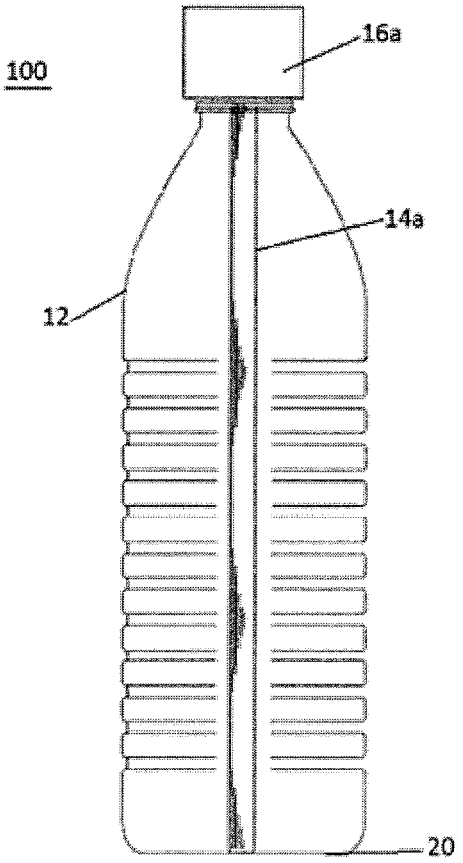
FIG. 3 is a front perspective view of another beverage packaging container embodiment of the disclosure.

As shown in FIG. 3, beverage container apparatus 100 for packaging a beverage item includes a container body 12, hollow rod body 14*a*, and elongated removable cap 16*a*. The container body 12 typically has a closed bottom 20, top 22, and sidewall 24. Generally, the bottom 20, top 22, and sidewall 24 define a spatially-confined interior. As introduced in FIG. 4, the top 22 generally includes an opening upper orifice face 26 and threads 28*a* to mate with the elongated removable cap 16*a*. The elongated removable cap 16*a* has a sufficient height dimension to enclose the distal end 34 of hollow rod 14*a* and mate with the container's plurality of threads 28*a* in the closed position shown in FIG. 3. Those of ordinary skill having the benefit of this disclosure will recognize additional orientations and container arrangements, including a variety of orifice and rod designs and dimensions.

Figure 4:
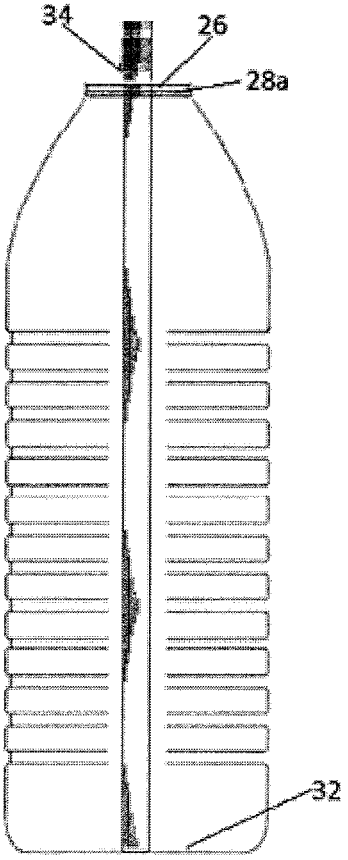
FIG. 4 is a front perspective view of the beverage packaging container according to FIG. 3, with portions omitted to show internal elements.

FIGS. 3 and 4 illustrate the hollow rod body 14*a* generally aligned within between the elongated removable cap 16*a* and closed bottom 20. The storage position may include any variety of sealed, closed arrangements prior to, and in particular examples, re-sealed or re-closed arrangements.

As shown in FIG. 3, the hollow rod body 14*a* may be aligned perpendicular between the elongated removable cap 16*a* and closed bottom 20. Other alternative embodiments may include a variety of angled or bent hollow rod body arrangements. Typically in this embodiment, the hollow rod body 14*a* has a proximate end 32 that is received within the container body and a distal end 34 that is adapted to protrude through the plane of the upper orifice face 26 show introduced in FIG. 4.

In particular examples, the hollow rod body 14*a* has a height dimension that extends above the upper orifice face 26. For instance, the proximate end 32 is contained within a spatially-confined interior and a distal end 34 extends above the upper face in a storage position and in an operating position, thus the unexpected advantage of an elongated removable cap 16*a*.

In alternative examples, the hollow rod body 14*a* may exert compression against removable cap 16*a*, for instance to maintain alignment and transfer the spring, buoyant, extended hollow rod body 14*a* to break the plane of the upper orifice face 26. As shown in FIG. 4, particular embodiments of the hollow rod body 14 extend from the spatially-confined interior area to an off-axis alignment position 18 above the upper orifice face 26 in an operating position.

FIGS. 5 and 6, and 5A and 6A, introduce embodiments of the beverage container apparatus 200 for packaging a beverage item includes a container body 12, hollow rod body 14*a* protruding through a narrow orifice 52, and narrow removable cap 16*b*. The container body 12 typically has a closed bottom 20, top 22, and sidewall 24. Generally, the bottom 20, top 22, and sidewall 24 define a spatially-confined interior. As introduced in FIG. 6, the top generally includes a narrow upper orifice face 52 on planar ledge 50. In certain examples, the narrow upper orifice face 52 is centered about planar ledge 50

Further, threads 52 generally mate with the narrow removable cap 16*b*. The narrow removable cap 16*b* has a reduced diameter as compared to alterative cap arrangements to provide any of the functional and aesthetic benefits shown and described herein, and appreciated by those skilled in the art having the benefit of this disclosure.

Figure 5:
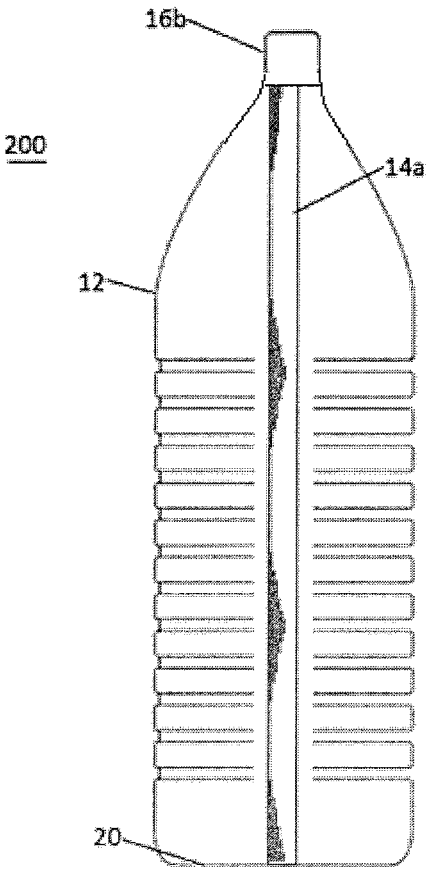
FIG. 5 is a front perspective view of another beverage packaging container embodiment of the disclosure.
Figure 6:
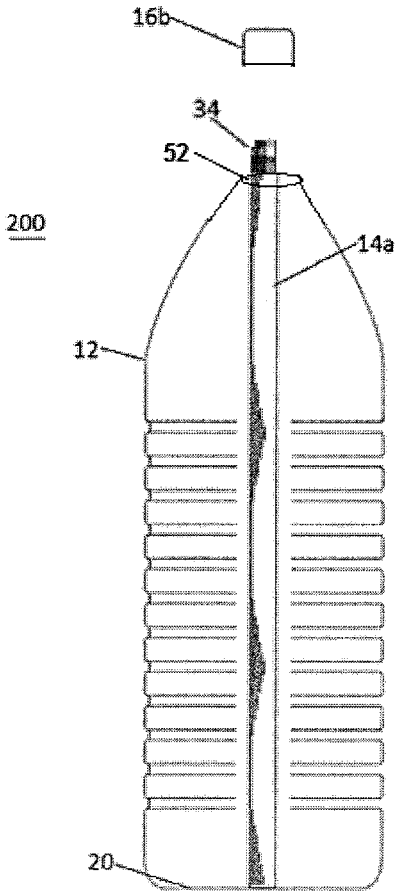
FIG. 6 is a front perspective view of the beverage packaging container according to FIG. 5, with portions exploded to show internal elements.
Figure 5A:
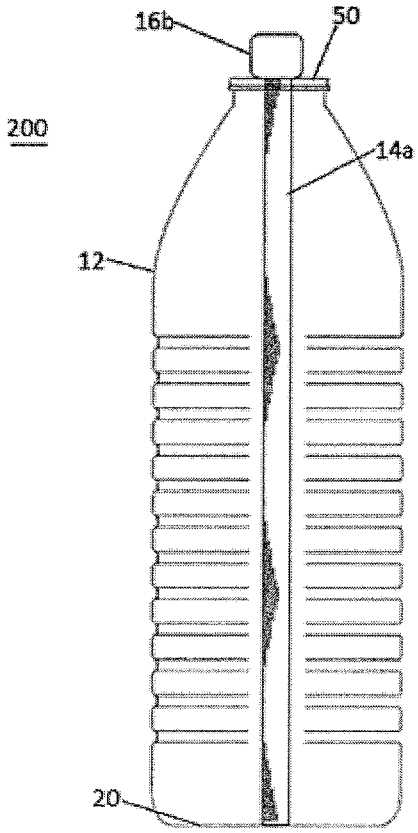
FIG. 5A is a front perspective view of another beverage packaging container embodiment of the disclosure.
Figure 6A:
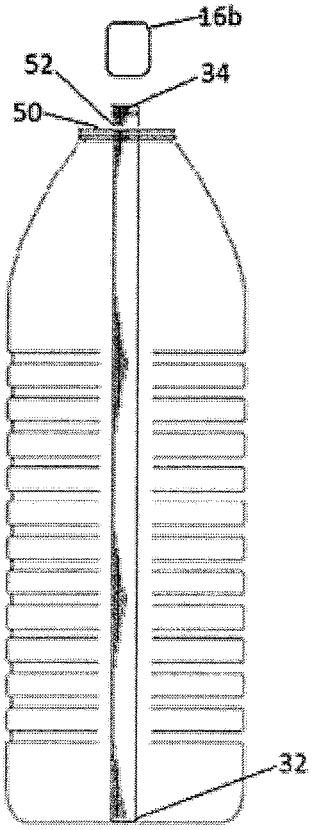
FIG. 6A is a front perspective view of the beverage packaging container according to FIG. 5A, with portions exploded to show internal elements.

FIGS. 5 and 6 illustrates the hollow rod body 14*a* generally aligned between the narrow removable cap 16*b* and closed bottom 20. The storage position may include any variety of sealed, closed arrangements prior to, and in particular examples, re-sealed or re-closed arrangements.

As shown, the hollow rod body 14*a* may be aligned perpendicular between the elongated narrow removable cap 16*b* and closed bottom 20. Other alternative embodiments may include a variety of angled or bent hollow rod body arrangements. Typically in this embodiment, the hollow rod body 14*a* has a proximate end 32 that is received within the container body and a distal end 34 that protrudes through the plane of the narrow orifice 52 as show and described herein.

In particular examples, the hollow rod body 14*a* has a height dimension that extends above the narrow orifice 52. For instance, the proximate end 32 is contained within a spatially-confined interior and a distal end 34 extends above the upper face in a storage position and in an operating position, thus the unexpected advantage of a narrow removable cap 16*b*. The orifice may be any dimension and shape, including, but not limited to a diameter of about half an inch to about an inch. Applicants have discovered unexpected advantages of an orifice having a diameter of about five sixteenths of an inch. In alternative examples, the hollow rod body 14*a* may exert compression against removable cap 16*a*, for instance to maintain alignment and transfer the spring, buoyant, extended hollow rod body 14*a* to break the plane of the upper orifice face 26.

In any of the examples and embodiments herein, the caps may be hinged, fastened, affixed with adhesives, etc. to provide access to the distal end of the rods. For instance, as shown in FIGS. 8 and 9.

Figure 7:
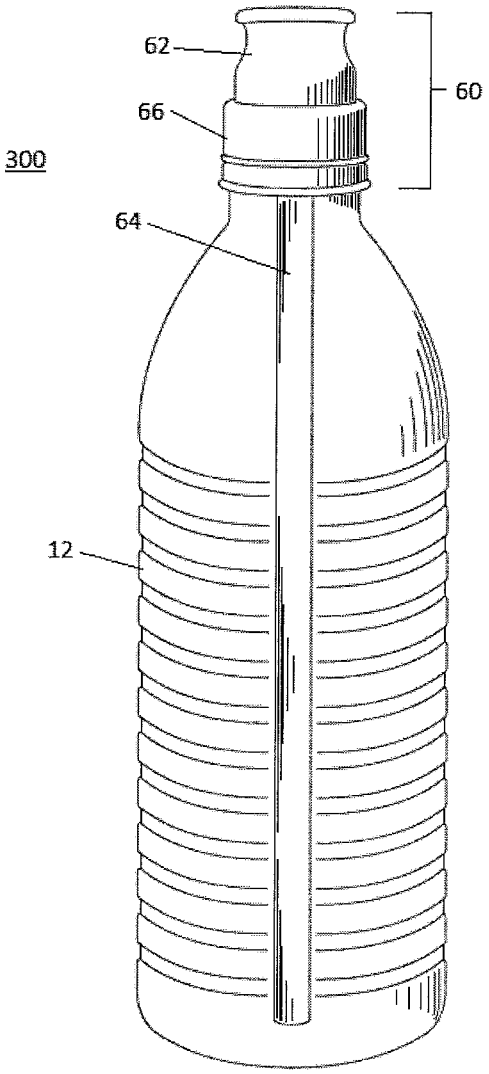
FIG. 7 is a front perspective view of another beverage packaging container embodiment of the disclosure.
Figure 8:
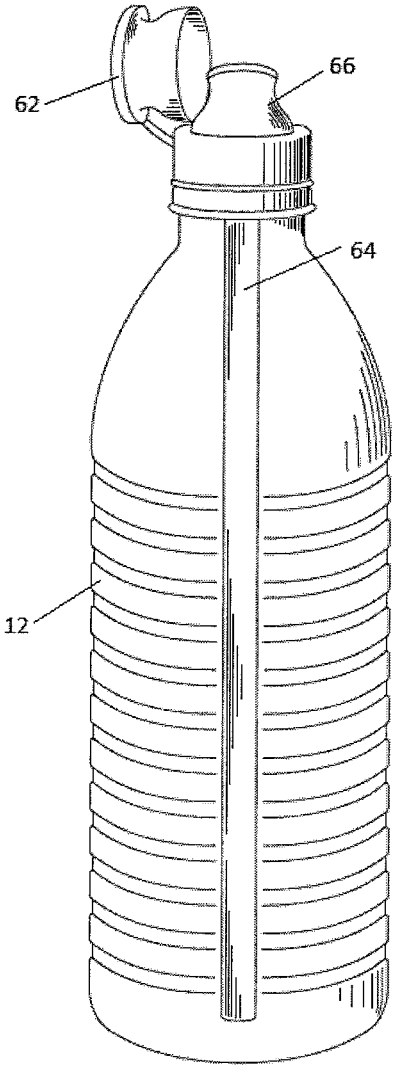
FIG. 8 is a front perspective view of the beverage packaging container according to FIG. 7 in an operating position.
Figure 9:
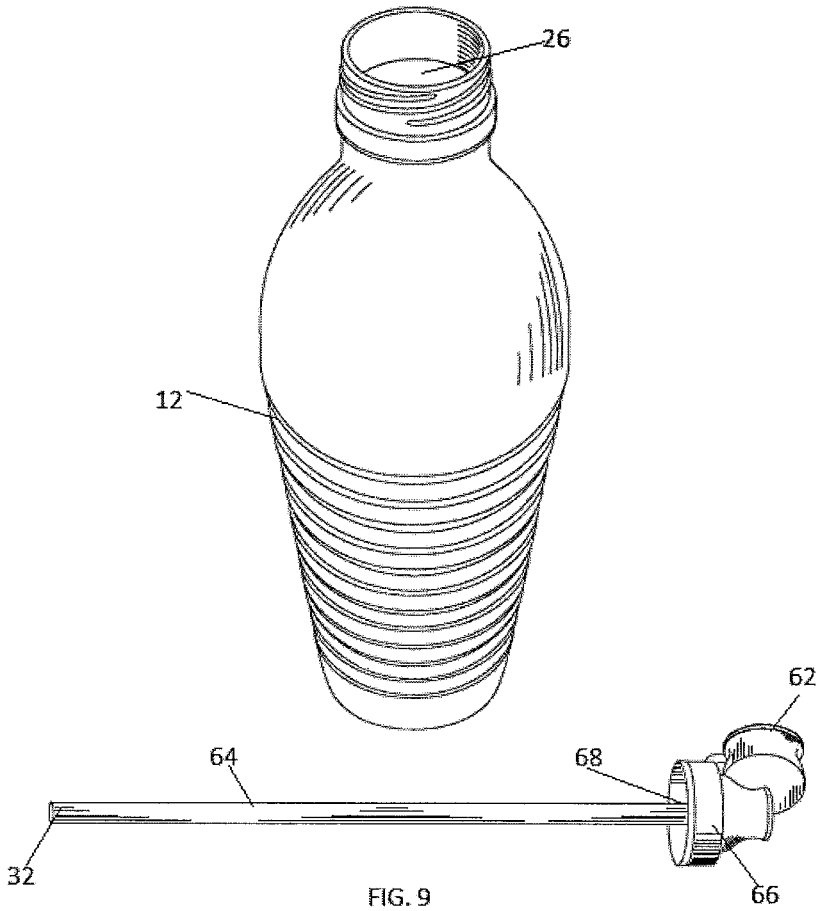
FIG. 9 is an exploded perspective view of the beverage packaging container according to FIG. 7, with portions isolated to show internal elements.

As also shown in FIGS. 7-9, a fitting 60 to mate with any variety of beverage container may include an upper segment 66 having threads, adhesives, fasteners, or the like to mate and align the semi or rigid hollow rod 64 with any variety of containers. The fitting 60 may include a cap 62 that is releasably adapted to enclose the upper segment 66. As further introduced in FIGS. 8 and 9, the upper segment may have a sidewall 68, and the proximate end of the rigid hollow rod 64 is received within the container in an assembled position, while the distal end may be permanently, or semi-permanently, affixed within sidewall 68. Those of ordinary skill in the art having the benefit of this disclosure will recognize alternative fitting designs and arrangements incorporated herein.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

We claim:

1. An apparatus for packaging a beverage item comprising:

a sealed container body having a closed bottom, a top, a sidewall, an opening upper face aligned adjacent said top and having threads, wherein said bottom, top, and sidewall define a spatially-confined interior free of a threaded neck;

a single use buoyant hollow rod body having a continuous cylindrical planar body being rigidly non-bending and removably aligned within said spatially-confined interior in a storage position; and a disposable removable elongated cap fitting forming said sealed, closed arrangement with said top about said threads in a closed position and having a sufficient height adapted to enclose at least a length of a distal end of said hollow rod body above said container top and housed within said cap height, and thereby substantially mates with said threads in said closed position, and wherein said single use buoyant hollow rod body being removably biased in said container body, and wherein said apparatus transfers said hollow rod from said spatially-confined interior area in an unbiased position to a biased position substantially above said upper face breaking said sealed, closed arrangement and exposing said hollow rod in a single-use operating position.

2. The apparatus of claim 1, wherein said hollow rod having a vertical height dimension greater than a vertical height dimension of said container body, and whereby said hollow rod aligned at an angle alpha with respect to a bottom surface of said container body in said storage position.

3. The apparatus of claim 2, wherein said hollow rod consisting essentially of a disposable, single-use rod.

4. The apparatus of claim 1, wherein said hollow rod includes an outer surface comprising an outer body wrap.

5. The apparatus of claim 4, wherein said outer body wrap includes at least one graphic.

6. The apparatus of claim 4, wherein said container body includes at least one corresponding graphic.

7. The apparatus of claim 1, wherein said hollow rod comprises a flavored straw.

8. The apparatus of claim 7, including flavored pellets affixed to said flavored straw.

9. The apparatus of claim 1, wherein said container body includes a male connector and said cap fitting includes a female connector adapted to mate with said male connector in a removably affixed, liquid impermeable position.

* * * * *